US005752355A

United States Patent [19]

Sahramaa

[11] Patent Number: 5,752,355

[45] Date of Patent: May 19, 1998

[54] TONGUE AND GROOVE MULTIPLE STEP PANEL

[76] Inventor: Kimmo J. Sahramaa, 11301 S. Shore Rd., Reston, Va. 22090

[21] Appl. No.: 771,821

[22] Filed: Dec. 12, 1996

[51] Int. Cl.[6] ..... E04D 1/00

[52] U.S. Cl. ..... 52/539; 52/519; 52/525; 52/529; 52/531; 52/535; 52/537; 52/555; 52/557

[58] Field of Search ..... 52/519, 523, 525, 52/527, 528, 529, 530, 531, 535, 537, 539, 536, 541, 555, 556, 557, DIG. 15; 29/897, 897.3, 897.32, DIG. 3

[56] References Cited

U.S. PATENT DOCUMENTS

| | | | |
|---|---|---|---|
| 256,083 | 4/1882 | Walter . | |
| 373,373 | 11/1887 | Montross | 52/529 |
| 503,173 | 8/1893 | Spahmer, Jr. | 52/537 X |
| 1,149,204 | 8/1915 | Martin | 52/529 |
| 1,163,556 | 12/1915 | Probert . | |
| 1,226,564 | 5/1917 | Miller | 52/535 |
| 1,329,794 | 2/1920 | Moomaw . | |
| 2,173,774 | 9/1939 | Birch et al. . | |
| 2,305,008 | 12/1942 | Howard | 52/528 X |
| 3,347,001 | 10/1967 | Cosden | 52/530 X |
| 3,754,366 | 8/1973 | Jansson et al. | 52/535 |
| 4,593,512 | 6/1986 | Funaki | 52/519 |
| 4,671,037 | 6/1987 | Bienvenu | 52/531 X |
| 5,201,158 | 4/1993 | Bayley et al. . | |
| 5,465,543 | 11/1995 | Seifert . | |
| 5,524,409 | 6/1996 | Kaiser . | |
| 5,613,337 | 3/1997 | Plath et al. | 52/523 X |

FOREIGN PATENT DOCUMENTS

| | | | |
|---|---|---|---|
| 544151 | 7/1957 | Canada | 52/519 |
| 2239031 | 6/1991 | United Kingdom | 52/783.11 |

*Primary Examiner*—Wynn E. Wood
*Assistant Examiner*—Laura A. Callo
*Attorney, Agent, or Firm*—A. David Pellinen

[57] ABSTRACT

Sheet metal multiple stepped tile panels are joined to similar roof panels in interlocking relationship. On one edge running the length of the panel is a single female groove while the opposite edge of the panel has a plurality of male members which can engage the single groove of a similarly shaped panel. The stepped panel is quite long compared to its width. Hidden screws in a securing flange join the panel to a roof.

12 Claims, 4 Drawing Sheets

TONGUE AND GROOVE MULTIPLE STEP PANEL

BACKGROUND OF THE INVENTION

Roof covers con be made of various materials including sheet metal. It is common when fastening metal panels to roofs for screws or nails to be driven into a flange and hide the screw or nail with an overlapping panel. Male and female members on opposite sides of the panel are joined to similar panels in interlocking relationship.

In prior art panels both the male and female members extend the entire length of the panel, from one end to the other end, in a continuous unbroken manner.

Stepped tile panels are well known in the art. Prior art multiple stepped tile panels have not had male and female members. The panel can have a single step or multiple steps. The single step would have a single riser in a longitudinal direction and a number of valleys between horizontal surfaces. Single step panels could have tongue and groove engagement By multiple steps is meant two or more risers extending in the longitudinal direction. Multiple stepped panels have not had tongue and groove engagement. The normal technique is to use screws driven through the surface of the panel in order to fasten them to the roof. When the driven fastener is not hidden rain water can eventually penetrate around the screw or nail onto the roof causing deterioration of the panel, the roof, or both.

SUMMARY OF THE INVENTION

This invention relates to sheet metal stepped tile panels that can be joined to similar roof panels in interlocking relationship. On one edge running the length of the panel is a female groove and a fixing flange. On the opposite edge of the panel are a plurality of male members. The fastening means, such as screws, are hidden from the elements and from view.

With this relationship of male and female members panels can be quite long compared to the horizontal width. The ability to manufacture such interlocking stepped panels lends itself to the use of automated manufacturing equipment allowing bulk production runs, permitting panel inventories to be kept closer to the customer, whereby shorter delivery times can be attained.

DETAILED DESCRIPTION OF THE INVENTION

Figure 1:
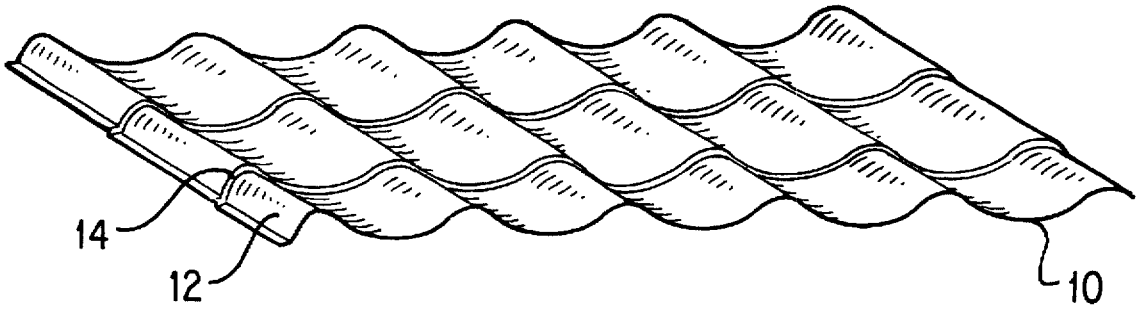
FIG. 1 PRIOR ART
FIG. 1 is a perspective view of a prior art sheet metal stepped tile panel with a curved profile.

FIG. 1 shows a prior art sheet metal stepped tile panel. The panel has an undulating or curved profile 10. The profile is contoured by surface portion or step 12 and is stepped up at riser 14 Additional surfaces and steps similar to step 12 and riser 14 complete the panel. The profile could have other undulations or curves. The profile can be a combination of a curve and a valley 20 as shown in FIG.2.

Figure 2:
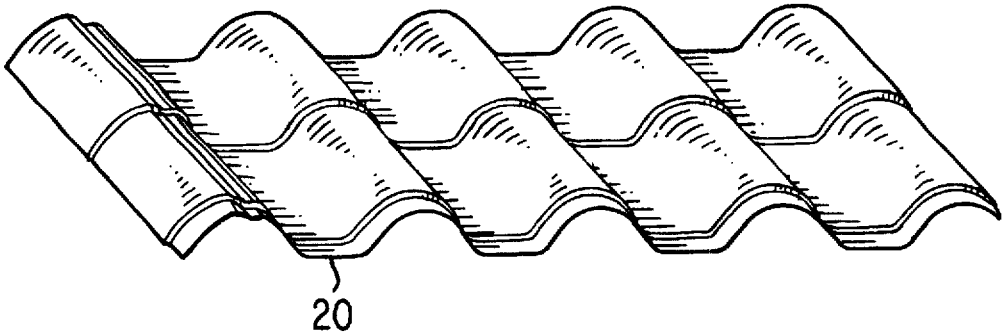
FIG. 2 PRIOR ART
FIG. 2 is a perspective view of a prior art sheet metal stepped tile panel having both a curve and a flat profile.
Figure 3:
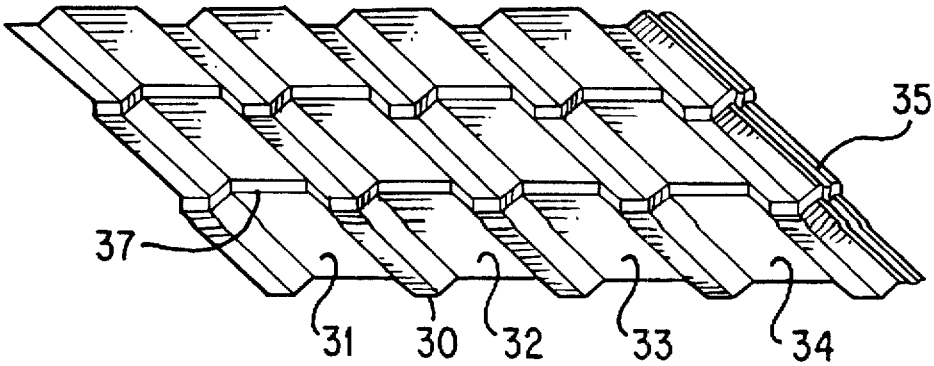
FIG. 3 PRIOR ART
FIG. 3 is a perspective view of the prior art sheet metal stepped tile panel with a trapezoidal profile.

Referring to FIG. 3 the steps 31, 32, 33, 34 are relatively flat with channels 30 between the surfaces and thus have a trapezoidal profile. The step 31 is stepped up at riser 37. In a manner similar to FIGS. 1 and 2 additional surfaces and risers similar to step 31 and riser 37 complete the panel. The panel edge contains a water channel 35.

In use the prior art panels of FIGS. 1–3 are placed on the roof and adhered to the roof by screws, nailing or other fastening means driven through any part of panel. Subsequent panels are placed in overlapping relation to complete the roof paneling. Screw fastening is preferred but placing screws on stepped panels cause the fastening area be exposed to the elements with consequent deterioration of the panels as well as the roof. In order to provide good seal for screws, for example, gasket rings can be provided. These gasket rings improve the seal but care must be exercised to achieve proper pressure lest distortion of the panel or failure of the gasket result. In addition because roofs can have structures more complicated than a mere simple rectangular configuration the prior art panels cause material to be wasted.

Figure 4:
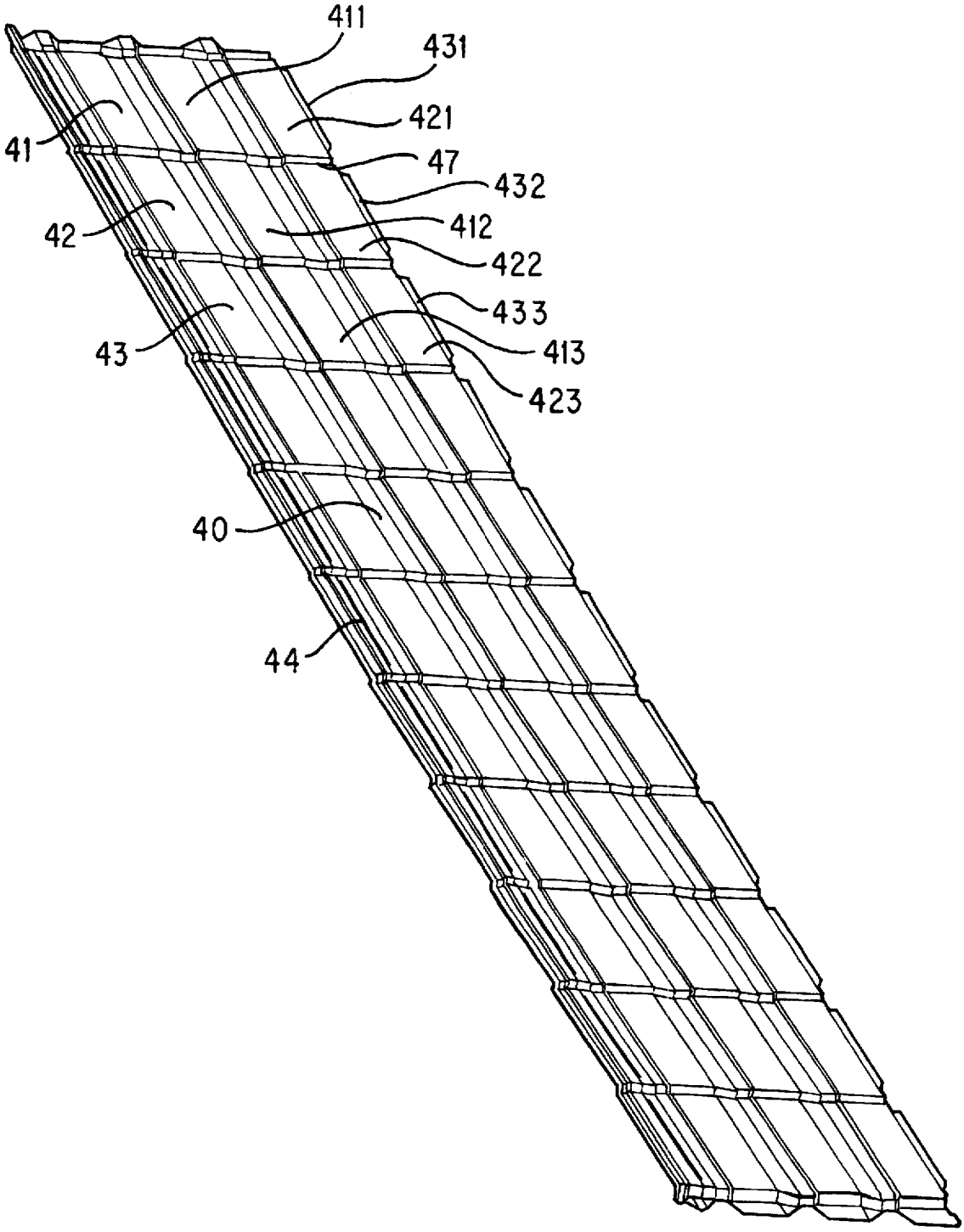
FIG. 4 is a perspective view of the sheet metal panel of the invention.

FIG. 4 shows a single sheet metal stepped panel according to the invention. FIG. 4 has male members and a female member to provide an improved interconnecting feature. A plurality of steps extend across the length and breath of the panel. Steps 41, 42, 43 extend in a generally longitudinal direction, as do steps 411, 412, 413, and 421, 422, 423. Between the steps, such as between 41 and 411, is a valley 40 extending the length of the panel which is shown in greater detail in FIG. 6. Each step is associated with a riser such as 47 between steps 421 and 422. For purposes of definition a surface portion, such as 41, is considered a step because the riser 47 increases the height from a surface such as 42 to a surface 41. As depicted in FIG. 4 the length of the panel is considerably longer than the width of the panel. A series of tongues or male members 431, 432, 433 are at the right edge of the panel while a single female groove 44 is at the left, opposite, edge of the panel. It is important to note that groove 44 is a single groove extending the length of the panel, although the groove becomes pressed at the riser portions during the step forming operation. As shown the panel has a plurality of tongues. Preferably each step has a single tongue associated with it so that the number of tongues is equal to the number of steps in the longitudinal direction of the panel. Thus step 421 has tongue 431 along its edge, step 422 has tongue 432 along its edge, and step 423 has tongue 433 along its edge. When the panel is joined to a similarly configured adjacent panel the tongues will engage the single female groove in interlocking relationship.

The steps, such as 41, 42, located near the groove can be considered primary steps while the steps, such as 421, 422, at the tongue can be considered secondary steps, while the steps such as 411, 412, intermediate the primary and secondary steps, can be considered central steps. For a wider horizontal application another plurality of steps in parallel with central steps 411, 412, and 413 would increase the width.

While each step has a single tongue as shown it is within the scope of the invention to have two or more tongues. Similarly it is within the scope of the invention to reverse the position of the male and female members so that the tongues are positioned on the left edge of the panel with the groove on the right edge.

Figure 5:
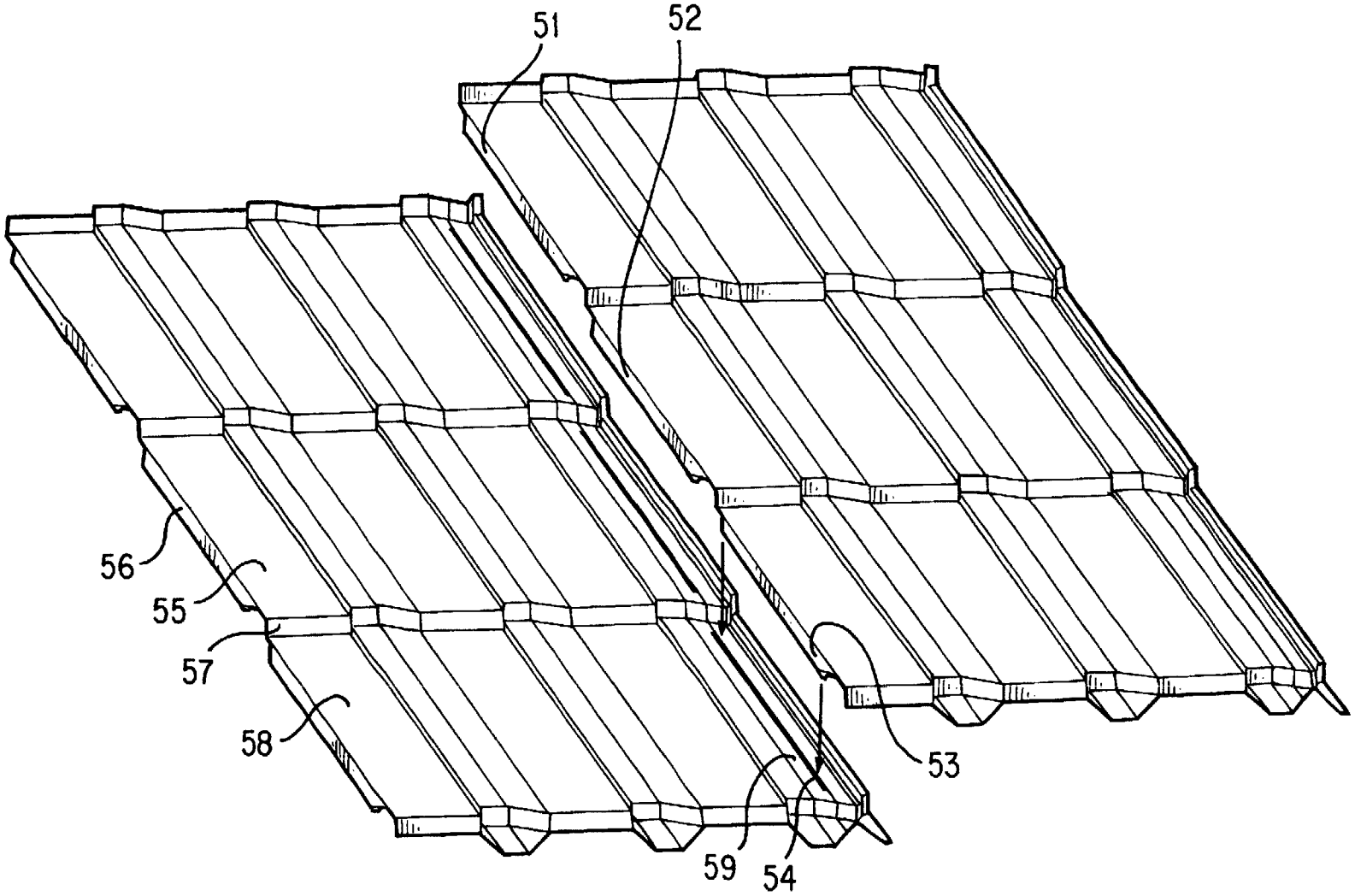
FIG. 5 is an exploded view of a portion of a panel prior to engagement with another similar panel.

FIG. 5, an exploded perspective view of a portion of two panels, shows how two adjacent panels will interlock, and also illustrates the reversal of the tongues from the right edge in FIG. 4 to the left edge in FIG. 5. Tongues 51, 52, 53 will latch into single groove 54, such as shown by the arrows from tongue 53 to groove 54. The portion of groove 54 between steps, where the male members engage the groove, is shown in darker lines.

Each of the steps has a first surface, such as 55, lying in a plane. Extending along the left edge of step 55 is tongue 56. As more clearly seen in FIG. 5, each tongue 56 is discontinuous because it does not extend the entire length of the edge but only along a portion of the edge. At an end of step 55 is a depending second surface, riser 57, extending downwardly to join surface 58. At the right edge of the panel is an edge rib such as 59 with groove 54, shown in greater detail in FIGS. 6 and 7, the grove extending the length of the panel.

Figure 6:
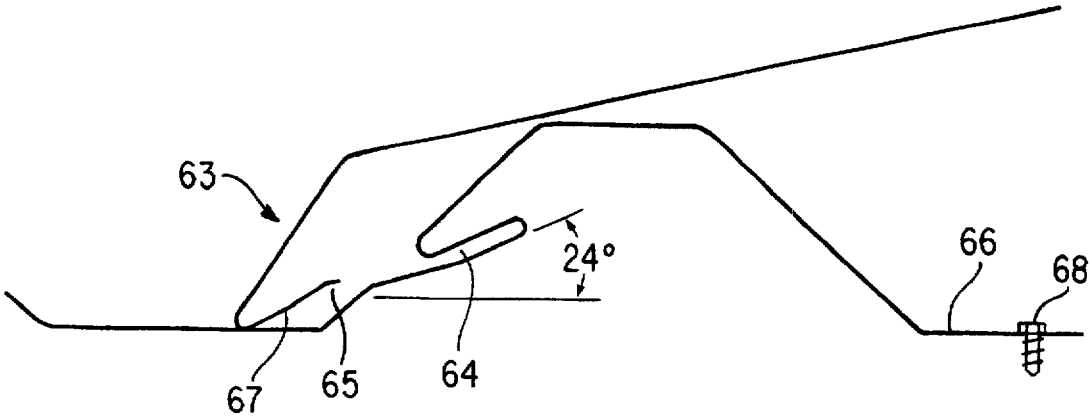
FIG. 6 is an enlarged view of male and female members prior to engagement.
Figure 7:
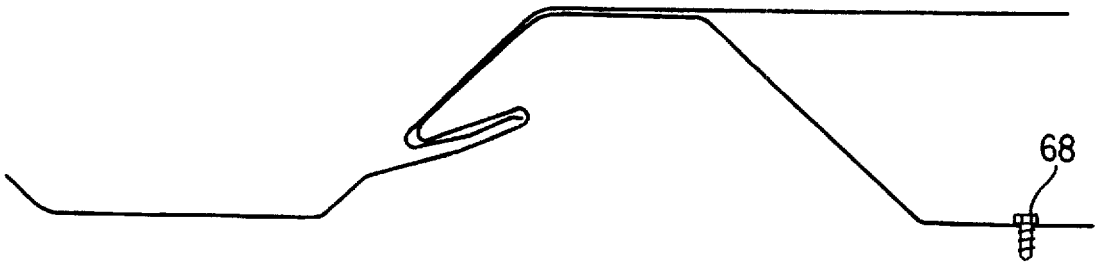
FIG. 7 is a view similar to FIG. 6 with the male and female members engaged.

FIGS. 6 and 7 are enlarged views of the interlocking engagement. In FIG. 6 the female groove 64 is shown inclined at an angle of 24 degrees. The particular angle is a matter of design and choice and could have some other value. Whatever degree of incline is chosen it is desirable that it be sufficiently steep to allow any water that may be present to drain or otherwise flow away from the groove.

The tongue or male member 63, as shown in FIG. 6, has its terminal or end portion 65 slightly inclined from portion 67. When the panels are in interlocking engagement portions 65 and 67 ease engagement with the groove 64 and the inclination further serves to permit drying of any water. In FIG. 7 the male and female members are shown in firm engagement. The actual male and female members could have other configurations as long as the panels are in interlocking engagement.

Figure 8:
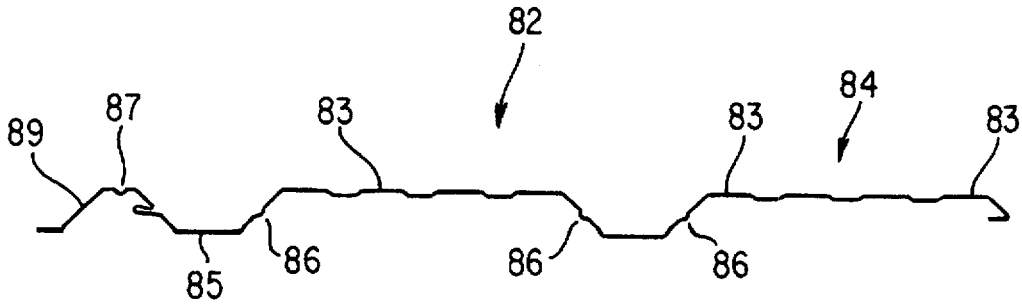
FIG. 8 is a profile of a panel of the invention.

In FIG. 6 the right edge of the panel has a flange 66 which extends the length of the panel to permit screws such as 68 to fasten the panel to the roof. As shown in FIG. 7 such a fastener would be hidden from view in a completed installation. Such a secret fix adds to the aesthetic appearance, as well as avoiding the ingress of water or other fluids that exposed fasteners are subjected to thus enhancing the life of the panel and the roof. The screws pass through prepunched oval holes which permit thermal movement of the panel FIG. 8 is a profile view of a panel with the edge rib 89 on the left edge and tongue on the right edge. Two steps 82, 84 are shown although the number of steps in this trapezoidal configuration are subject to choice. Channels 85 are between adjacent steps and the edge rib. Stiffening ribs 83 on the steps increase the rigidity of the panel, an important feature when people need to walk on the panel surfaces. The channels are shown with sloping sides meeting at a bottomed portion. Indentations 86 serve as shadow lines to give a uniform appearance to the panel. When viewing panels at a completed installation this uniformity provides a pleasing overall appearance. The channel can take various forms and is not limited to that shown in FIG. 8. As the function of the channel is to carry rain water or other debris then other channel shapes can perform this function. At edge rib 89 a water groove 87 runs the length of the panel. Capillary action is eliminated by the groove.

A primary advantage of the invention is the provision of a multiple stepped tile panel with tongue and groove engagement, the multiple steps arranged in a longitudinal direction and thus making a hidden securing flange possible such engagement has not been possible and thus stepped panels were screwed or otherwise fastened through the panel surface. According to the invention hidden fasteners can now be used with stepped panels, a particularly useful feature when employing a plurality of steps.

The narrow width of the panel offers additional advantages. With a narrow width little waste occurs in complicated roof designs. Because the edge rib is relatively narrow there is less overlap with additional savings in material.

The narrow panel also limits the uplift from winds. This follows from the fact that screwing or fastening occurs at the edge securing flange of the panel, thus resulting in a narrow span. Wind uplift force applied to fastenings of each panel are limited. This narrowed span also reduces the tendency for the panel to be deflected. Pull out and tearing of the panels is reduced as the resistance to wind lift is increased.

Still another advantage is that panels can be cut diagonally and the diagonally cut portions used at other roof locations. This results from the fact that because the panel is narrow the cut portion will likely include both male and female members. The wider panels of the prior art when cut diagonally are not as readily reusable.

The panels of the invention can be a commodity product with a predetermined length and width permitting inventories to be kept closer to the customer and can be distributed through existing building material marketing channels. The sheet metal panel can be precoated in various colors to coordinate the roof color with that of the building or surroundings.

I claim:

1. A stepped tile panel for installation on a building roof or exterior for engagement with an adjacent panel or panels comprising:

a plurality of steps in said panel extending in a longitudinal direction, each of said steps having first and second edges, each of said steps having a riser portion;

a single groove extending along said first edges of said steps, said single groove extending the length of said panel including said riser portion of said steps;

a plurality of discontinuous tongues, each of said tongues extending along a portion of said second edges of said steps;

whereby said plurality of tongues are for engagement with a groove of an adjacent panel in interlocking engagement.

2. The panel of claim 1 wherein the number of tongues is equal to the number of steps.

3. The panel of claim 1 wherein said first edges include a securing flange.

4. A stepped tile panel for installation on a building roof or exterior for engagement with an adjacent panel or panels comprising:

a plurality of primary steps extending in a longitudinal direction in said panel, each of said primary steps having first edges, each of said primary steps having a riser portion;

a single groove extending along said first edges of said primary steps, said single groove extending the length of said panel including said riser portion of said primary steps;

a plurality of secondary steps in said panel, each of secondary steps having second edges;

a plurality of discontinuous tongues, each of said tongues extending along a portion of said second edges of said secondary steps;

whereby said plurality of tongues are for engagement with a groove of an adjacent panel in interlocking engagement.

5. The panel of claim 4 wherein the number of tongues is equal to the number of secondary steps.

6. The panel of claim 4 wherein said first edges include a securing flange.

7. The panel of claim 4 wherein a channel separates said primary and secondary steps.

8. A stepped tile panel for installation on a building roof or exterior for engagement with an adjacent panel or panels comprising:

a plurality of central steps in said panel extending in a longitudinal direction;

a plurality of primary steps located to one side of said central steps, said primary steps having a first edge, each of said primary steps having a riser portion;

a single groove extending along said first edge, said single groove extending the length of said panel including said riser portion of said primary steps;

a plurality of secondary steps located to another side of said central steps, said secondary steps having a second edge;

a plurality of discontinuous tongues, each of said tongues extending along a portion of said second edge;

whereby said plurality of tongues are for engagement with a groove of an adjacent panel in interlocking engagement.

9. The panel of claim 8 wherein the number of tongues is equal to the number of secondary steps.

10. The panel of claim 8 wherein said first edge include a securing flange.

11. The panel of claim 8 wherein a channel separates said primary and central steps, and another channel separates said secondary and central steps.

12. The panel of claim 8 wherein a further plurality of steps extends in parallel with plurality of central steps.

* * * * *